United States Patent [19]

Gagnon et al.

[11] 4,438,903

[45] Mar. 27, 1984

[54] OBSTACLE DETECTOR FOR A DESCENDING OR ASCENDING LOAD

[76] Inventors: Pierre Gagnon, 5637 Wilderton Ave., Montreal, Canada, H3T 1S1; Pierre Laforest, 1945 Bruxelles St., Montreal, Canada, H1L 5Z5

[21] Appl. No.: 375,884

[22] Filed: May 7, 1982

[51] Int. Cl.[3] ..... B66D 1/48; E05F 15/02

[52] U.S. Cl. ..... 254/269; 49/28; 254/284; 254/316

[58] Field of Search ..... 254/269, 270, 283, 286, 254/316, 264, 284; 49/26, 27, 28; 212/149, 151, 212/222; 160/193

[56] References Cited

U.S. PATENT DOCUMENTS

| | | | |
|---|---|---|---|
| 2,811,262 | 10/1957 | Schaitberger | 254/264 X |
| 4,199,133 | 4/1980 | Gagnon et al. | 254/361 X |
| 4,271,934 | 6/1981 | Gagnon et al. | 188/170 |

FOREIGN PATENT DOCUMENTS

| | | | |
|---|---|---|---|
| 636776 | 2/1962 | Canada . | |
| 1138908 | 10/1962 | Fed. Rep. of Germany | 254/273 |
| 1198510 | 8/1965 | Fed. Rep. of Germany | 212/149 |
| 2337096 | 7/1977 | France | 254/270 |

*Primary Examiner*—Billy S. Taylor
*Assistant Examiner*—Katherine Jaekel

[57] ABSTRACT

An obstacle detector is disclosed, being designed to automatically brake a descending or ascending load suspended on at least two spaced cables, should an obstacle be encountered in the path of the load. The detector comprises at least two winch drums and a rotatable horizontal rod having at least two laterally-spaced levers projecting radially therefrom and inclined on opposite sides of the rod. One end of each cable is secured to a drum, passes through a pulley supporting the load and is secured to a corresponding lever at its other end. A change in the tension of one of the cables, due to an obstacle, results in a small rotation of the rod, thus activating an electric sensing device which effectively shuts down the motor driving the winch drums.

7 Claims, 5 Drawing Figures

OBSTACLE DETECTOR FOR A DESCENDING OR ASCENDING LOAD

FIELD OF THE INVENTION

The present invention relates to an obstacle detector more specifically of the type which will cause automatic braking of a cable suspended descending or ascending load and adapted to be used, for example, with a battens system, designed to raise and lower sceneries on a stage.

BACKGROUND OF THE INVENTION

The prior art has disclosed various devices to raise the lower objects by the use of cables which wind around a winch drum. Battens system which raise and lower stage sceneries and cranes in the construction industry are but two examples of such devices.

Till now, such devices have not been completely safe, because there is no automatic way of stopping an object being lowered or raised by cables whenever said object contacts a person or other obstacle in its path. In the case of a theatre battens system, an operator is needed to warn stage hands and actors of descending scenery and constantly look after the same.

OBJECTS OF THE INVENTION

In view of the above, it is a first object of this invention to provide a device which will produce automatically braking of cables, should an obstacle lie in the vertical path of an object being lowered or raised by the cables.

It is another important object of this invention to provide an obstacle detector of the above type, which is simple in design and construction and non-costly to produce.

SUMMARY OF THE INVENTION

The obstacle detector of the invention is used in combination with an object-raising system comprising at least two spaced-apart winch drums adapted to wind and unwind a cable. The object to be raised and lowered is thereby supported at least at two different and spaced-apart points by the cables.

The winch drums are preferably axially aligned for reasons of simplicity of design and construction, although such an arrangement is, by no means, essential to the invention. Both winch drums are rotatively supported by appropriate mounting means and both receive their power from a reversible drive motor.

A torque-sensitive rod is mounted by a second mounting means which allows it to rotate about its own axis. This rod is formed with at least two spaced-apart and rigidly secured, radially projecting torque members.

The two cables are each secured to these torque members after passing through a pulley located one at each of the spaced-apart points mentioned above. Thus, one end of each cable is secured to its winch drum, while the other end is attached to a torque member.

The two torque members make an angle between themselves.

Electrical sensing means such as, for example, a potentiometer or series-connected mercury switch is activated by rotation of the rod in either direction to stop rotation of the drive motor.

How the invention works will be readily obvious: firstly, a load is attached to the pulleys of the two cables; then the two winch drums are activated to lower the load. In the event that the descending or ascending load encounters an obstacle, the cable closest to that point will experience a lessening or increase of tension, respectively. Consequently, the torque member attached to that cable will start to exert less or more torque, respectively, than its oppositely-inclined counterpart, causing the torque-sensitive rod to rotate axially a certain amount. This, in turn, will activate the electrical sensing means. The latter is electrically connected to means for stopping and braking the drive motor. Thus, the instant that a load hits an object during its descent, the winch motor is automatically shut down, stopping the load.

It is to be understood that more than two torque members and their associated cables can be provided if the load is exceptionally wide. If such is the case, two or more pairs of cables and torque members can be used.

BRIEF DESCRIPTION OF THE DRAWINGS

The above will be more clearly understood by having referral to the preferred embodiment of the invention, illustrated by way of the accompanying drawings, in which.

Like numerals refer to like elements throughout the drawings.

DETAILED DESCRIPTION OF THE INVENTION

Figure 1:
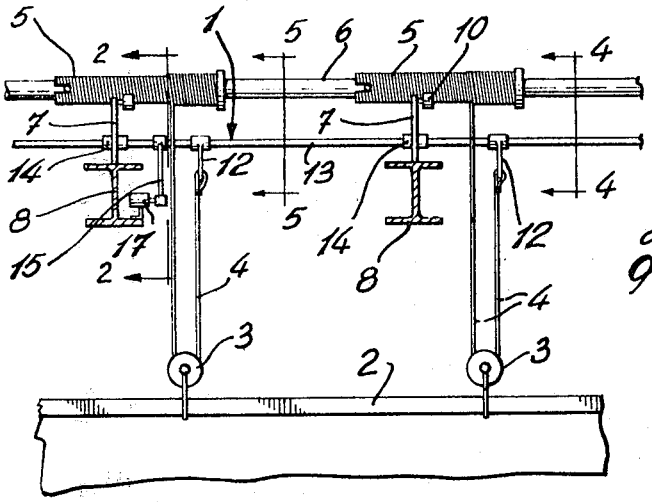
FIG. 1 is a partial front elevation of a battens system incorporating the obstacle detector of the invention.

The obstacle detector, indicated generally by the numeral 1 will be described in association with a battens system for raising and lowering stage scenery, such as the scenery 2 shown in FIG. 1.

Scenery 2 is supported along its upper edge by at least one pair of laterally spaced-apart pulleys 3.

A cable 4 passes through each of the pulleys 3. Each of the former is secured at one of its ends to a winch drum 5 which is adapted to wind and unwind the cables 4. The two winch drums 5 shown in FIG. 1 are securely mounted on a common shaft 6 and laterally spaced-apart such that each drum 5 overlies a corresponding pulley 3. Shaft 6 is connected to a reversible drive motor (not shown) which may or may not be electric. If it is not electric, an electric control motor is provided to control operation of the drive motor.

It is to be noted that although FIG. 1 illustrates a common shaft 6 the latter is not essential to the operation of the invention. What is essential is that all the drums 5 revolve simultaneously at the same speed to lower a stage scenery 2, thereby assuring that the latter will not tilt during its descent.

Figure 2:
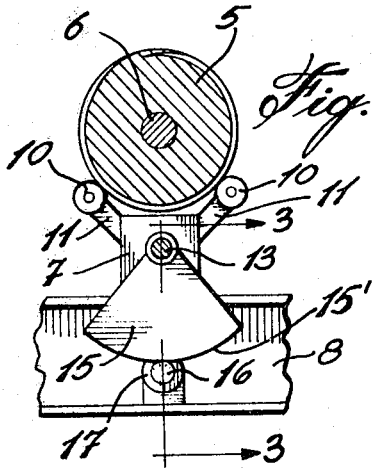
FIG. 2 is a sectional view taken along line 2—2 of FIG. 1.

Referring to FIG. 2 there is shown the support means for shaft 6. This support means consists of an upright plate 7 for each drum 5. Plates 7 are each rigidly secured at their lower ends to a structural girder 8. Each winch drum 5 is supported above the upper end of plates 7 by a pair of oppositely located roller bearings, 10 each of these being rotatively mounted on support arms 11. An Example of such an object raising system is described in applicants U.S. Pat. No. 4,199,133 dated Apr. 22nd, 1980 entitled "Battens system for raising and lowering sceneries on a stage".

The dead end of each of the cables 4 is secured to a torque member 12, which is in turn rigidly secured to a laterally and horizontally extending torque-sensitive rod 13. Torque member 12 may take the shape of a cam or of a lever as shown. Rod 13 is provided with a second mounting means consisting of axially aligned holes formed in each plate 7 and a bushing 14 extending through each hole on either side thereof. Rod 13 is thus rotatively held in bushings 14.

Figure 4:
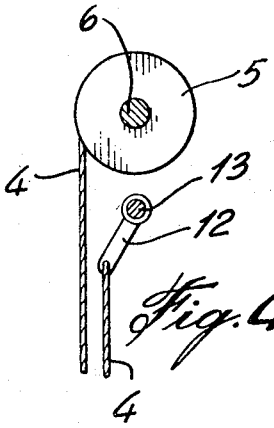
FIG. 4 is another sectional view taken along line 4—4 of FIG. 1.
Figure 5:
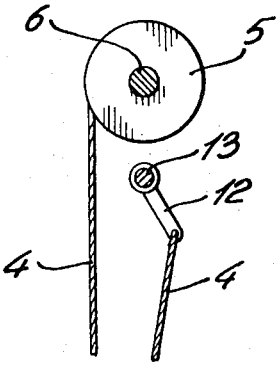
FIG. 5 is yet another sectional view taken along line 5—5 of FIG. 1.

FIGS. 4 and 5 illustrate how torque members 12 are positioned on rod 13: i.e. on opposite sides of the longitudinal vertical plane through which rod 13 extends. It is to be noted that, in FIG. 1, two torque members 12 are identically and oppositely inclined, making an angle of about 45° for maximum sensitivity. This arrangement is the same whenever there are additional pairs of cables 4 and their associated torque members 12 with the latter mounted on the same rod 13.

Rod 13 is further provided with a translational member 15 which is rigidly secured to rod 13 and projects radially therefrom. Member 15 converts the axial rotation of rod 13 into arc movement for greater sensitivity.

Figure 3:
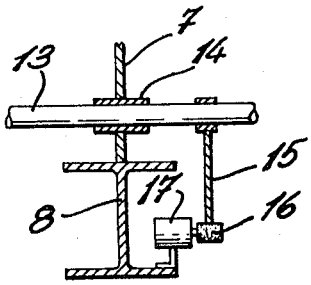
FIG. 3 is another sectional view taken along line 3—3 of FIG. 2.

Referring now to FIG. 2 there is shown one preferred embodiment of a translational member, consisting of a sector plate 15, secured to rod 13 at its apex and having a lower circular edge 15'. This surface operatively contacts a small rubber wheel 16 which is mounted on the shaft of a potentiometer 17. The latter is electrically connected, in a circuit which controls the operation of the reversible-drive motor which powers shaft 6. Potentiometer 17 is secured to a bracket which may be secured to an adjacent structural girder 8, as shown clearly in FIG. 3 and FIG. 1.

Referring again to FIG. 1, let us assume that the scenery 2 being lowered by the two cables 4 encounters an obstacle at its lower edge (not shown) adjacent the right side pulley 3. The obstacle will partially or completely block the further descent of that portion of the scenery 2, resulting in a lessening of the tension exerted on the corresponding cable 4. The consequent reaction will be unbalancing of the torque exerted on rod 13 by the oppositely-inclined torque members 12 and a small rotation of rod 13 about its own axis. Thus, sector plate 15 will move through a small arc and so activate potentiometer 17, thereby shutting off the drive motor. The drive motor is preferably associated with a brake, such as that described in applicants' U.S. Pat. No. 4,271,934 dated June 19, 1981 and entitled: "BRAKE", in order to obtain very fast stopping of the descending load. When the obstacle is in the path of an ascending load, the tension of the cable 4 nearer to the obstacle will increase again, causing rotation of rod 13 and detection by potentiometer 17.

It will be readily appreciated that the obstacle detector will function properly, no matter where along the length of scenery 2 an obstacle is encountered with the exception of the midpoint of scenery 2 between pulleys 3. To detect an obstacle at midpoint, a second assembly of a rod 13, a pair of torque members 12, pulleys 3, cables 4 and drums 5, identical to the assembly described, are provided with one pulley 3 attached to said midpoint and the other pulley attached to the scenery 2 at a point outside a pulley 3 of the first named assembly to detect cable tension unbalance at said midpoint.

It is also to be noted that the obstacle detector will act in response to a very small increase or decrease in the tension exerted on any of the cables 4 supporting the scenery 2. Furthermore, the scenery 2 may be heavier on one side or at its middle without impairing the functioning of the obstacle detector as long as the opposed torque forces on rod 13 are in equilibrium during the movement of scenery 2.

To obtain this, zero setting of potentiometer circuit is effected once the scenery has been suspended from cables 4.

Although the invention has been described as applied specifically to a battens system for a theater stage it will be clear that the principles and novel characteristics thereof can be equally successfully adapted to any machinery designed to raise and lower objects using at least one pair or spaced cables, without departing from the scope or spirit of the invention.

What we claim is:

1. A device for detecting the presence of an obstacle in the path of a descending or ascending load suspended from a pair of cables trained around a pair of spaced pulleys attached to the load and each having a dead end, said device comprising the combination of said cables with a rotatably-supported rod and a pair of radially-projecting and oppositely positioned torque members secured to said rod, each cable having its dead end secured to a respective torque member and exerting oppositely-directed and counterbalancing torque on said rod, whereby a decrease or increase of tension in one cable, due to contact of an obstacle with the descending or ascending load, respectively, will cause rotation of said rod, and further including rod rotation-sensitive means operable to cause stopping of said cables.

2. An obstacle detector for an object suspended from at least a pair of spaced cables wound on winch drums rotatively secured in a first mounting means and powered by a reversible-drive motor; both said winch drums designed to rotate simultaneously at the same speed; each said winch drum being adapted to wind and unwind one of said cables; said object to be raised and lowered by said winch drums; said detector comprising a torque-sensitive rod; said rod being provided with at least two laterally-spaced, rigidly secured, radially-projecting and oppositely positioned torque members; a second mounting means being provided for said rod; at least two laterally spaced-apart pulleys secured to said object; each said cable having one end secured to one of said winch drums, passing through one of said pulleys and having its dead end secured to the outer end of one of said torque members, and electric sensing means activated by rotation of said rod and adapted to be electrically connected in a control circuit for stopping said drive motor.

3. An obstacle detector as defined in claim 1 wherein said load is a scenery for a theater stage.

4. An obstacle detector as defined in claim 2 wherein said winch drums are rotatively mounted on a common shaft, being spaced-apart thereon; said first mounting means including an upright plate for each said drum having a lower end rigidly secured to a structural girder and an upper end formed with a pair of upwardly extending, oppositely located arms, the latter being in turn provided with roller bearings.

5. An obstacle detector as defined in claim 4 wherein said second mounting means consists of axially aligned holes formed in each said upright plate and a bushing fixed in each said hole.

6. An obstacle detector defined in claim 2 further including a sector plate having an apex rigidly secured to said rod and also having a circular edge, said electric sensing means having an operating wheel in rotational contact with said circular edge.

7. An obstacle detector as defined in claim 6 wherein said electric sensing means consists of a rotary potentiometer.

* * * * *